US005829145A

United States Patent [19]

Hughes

[11] Patent Number: 5,829,145

[45] Date of Patent: Nov. 3, 1998

[54] FOAM PLANE

[76] Inventor: Daniel L. Hughes, 1047 W. Francis, Unit F, Ontario, Calif. 91762

[21] Appl. No.: 925,841

[22] Filed: Sep. 8, 1997

[51] Int. Cl.[6] ..... B27C 1/10

[52] U.S. Cl. ..... 30/475; 30/306

[58] Field of Search ..... 30/475, 477, 484, 30/272.1, 276, 277.4, 362, 292, 306, 366, 365

[56] References Cited

U.S. PATENT DOCUMENTS

| | | | |
|---|---|---|---|
| 1,614,783 | 1/1927 | Fekete | 30/475 |
| 1,636,863 | 7/1927 | Jehle | 30/475 |
| 2,264,278 | 12/1941 | Danforth | 30/475 |
| 3,514,854 | 6/1970 | Norfleet | 30/292 |
| 5,022,160 | 6/1991 | Sharpe et al. | 30/475 |
| 5,497,556 | 3/1996 | Lebessis | 30/366 |

*Primary Examiner*—Hwei-Siu Payer
*Attorney, Agent, or Firm*—Loyal McKinley Hanson

[57] ABSTRACT

A foam plane apparatus for planing foam includes a frame, a cutting element mounted rotatably on the frame, and a motor on the frame for rotating the cutting element as a user moves the cutting element across a body of foam for purposes of planing the foam. The cutting element includes a drum that is directly coupled to the motor, and a plurality of longitudinally extending rows of radially protruding teeth on the drum that are accomplished with elongated blades mounted in slots in the drum. A retainer collar engages the blades in order to removably retain the blades in the slots while facilitating blade replacement. The motor is arranged on the frame to serve as one of two handles for the apparatus.

8 Claims, 2 Drawing Sheets

12
18
19
20
21A
21B
21C
21D
21E
21F
22A
22B
22C
22D
22E
22F
23
24
25
26
27
28
29
30
31
35
36
5
6

FOAM PLANE

BACKGROUND OF THE INVENTION

1. Technical Field

This invention relates generally to construction tools, and more particularly to a new and improved method and tool for planing polyurethane foam and other low density materials.

2. Description of Related Art

Construction workers often need to plane foam. They may need to do so, for example, after spraying polyurethane foam insulation between the upright studs of a wall. After the foam sets, a worker planes it flush with the studs before adding dry wall or other covering using a pneumatically driven tool called a "foam plane" or "scarfing tool".

A typical existing handheld foam plane is an assembly of an elongated cutting element that is rotatably mounted with an air motor on a handheld frame. The worker holds the assembly in two hands, places the cutting element against the surface of the foam, and then moves the assembly across the foam while the air motor rotates the cutting element. As he strokes the foam that way, a blade on the rotating cutting element planes the foam.

Although effective in many respects, existing foam planes have some problems that need to be overcome. Some existing foam planes, for example, include chain drives that couple the cutting element to the air motor. The chain drive can be somewhat cumbersome, unsafe, prone to fail, and relatively expensive.

In addition, cutting elements have certain drawbacks. One existing form of cutting element includes an elongated blade held in a 2.25-inch diameter helix around a 24-inch long rotatable shaft by posts protruding radially from the shaft to the blade. One problem with that arrangement is that in use (e.g., when hitting a nail) the blade sometimes breaks off the posts. When that happens, the whole cutting element must be removed for repair or replacement.

Another form of cutting element includes a blade in the form of a 18-inch long by 1.5-inch wide steel ribbon that is twisted lengthwise a full 360 degrees. The blade is rotatably mounted on the frame, couple by a chain drive to the air motor, and provided with sharp longitudinal edges that plane the foam as the blade rotates. But with that form of cutting element, the planing action can be somewhat slow and difficult to control. Thus, users need an improved foam plane design.

SUMMARY OF THE INVENTION

This invention addresses the problems outlined above by providing a foam plane with a new and improved cutting element and chain-free coupling to the air motor. The cutting element includes a rotatably mounted drum having several longitudinally extending rows of radially protruding teeth. That arrangement improves the planing action and it limit damage when hitting a nail.

The rows of teeth are accomplished by removably mounting several straight, flat blades (e.g., six 15-inch long blades cut from an existing band saw blade) in several longitudinally extending slots in the drum. That way of doing it enables use of commercially available blade stock. A removable retainer collar on the drum facilitates quick and easy blade replacement.

To paraphrase some of the claim language that is subsequently presented, an apparatus constructed according to the invention for planing foam includes a frame, a cutting element mounted rotatably on the frame, and means in the form of a motor on the frame for rotating the cutting element as a user moves the cutting element across a body of foam for purposes of planing the foam. The cutting element includes a drum rotatably mounted on the frame and a plurality of longitudinally extending rows of radially protruding teeth on the drum. The drum defines at least one longitudinally extending slot and the cutting element includes at least one blade held removably in the slot by a retainer collar on the drum. The air motor includes a rotatable shaft and the cutting element is preferably coupled directly to the rotating shaft of the air motor without a chain drive.

In line with the above, a method for planing foam includes the step of providing a handheld apparatus that includes a pneumatically powered, rotatable, cutting element such that the cutting element includes a drum rotatably mounted on the frame and a plurality of longitudinally extending rows of radially protruding teeth on the drum. The method proceeds by grasping the assembly and then moving the assembly across the foam while rotating the drum so that the teeth on the blades plane the foam. The following illustrative drawings and detailed description make the foregoing and other objects, features, and advantages of the invention more apparent.

DESCRIPTION OF THE PREFERRED EMBODIMENTS

Figure 1:
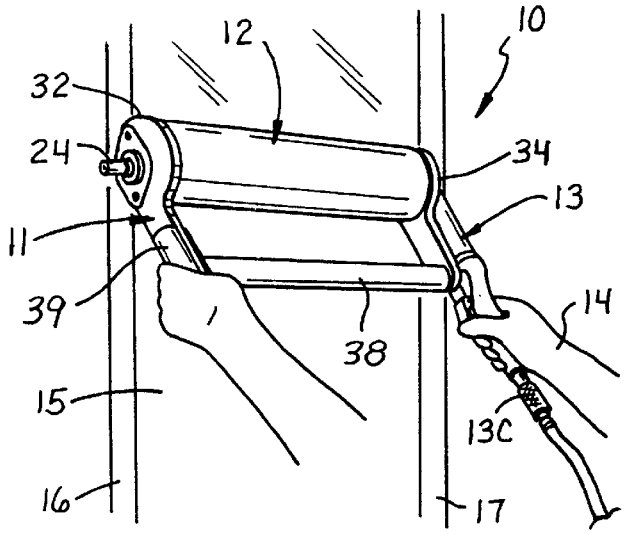
FIG. 1 of the drawings is a three dimensional view of a foam plane constructed according to the invention that is in operation as a user moves it across foam insulation that has been sprayed between two studs in order to plane the foam flush with the studs.
Figure 2:
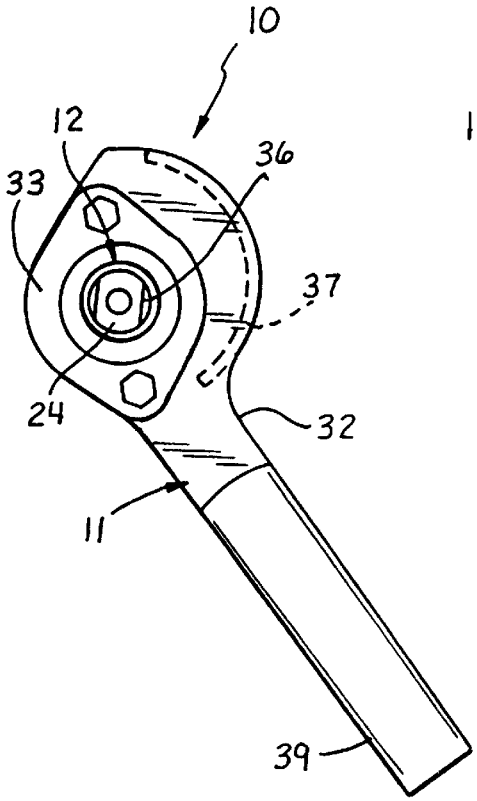
FIG. 2 is an enlarged left side view of the foam plane.

The drawings show a foam plane 10 constructed according to the invention. Generally, it includes a frame 11 (FIGS. 1–3), a cutting element 12 that is mounted rotatably on the frame 11, and a motor 13 that is also mounted on the frame 11. As depicted in FIG. 1, the motor 13 rotates the cutting element 12 (e.g., at 4500 RPM) as a user 14 moves the cutting element 12 across a body of foam 15 for purposes of planing the foam. The user 14 is illustrated planing a 14-inch wide swath across polyurethane foam insulation between two upright 2×4 studs 16 and 17 on 16-inch centers in order to plane the foam flush with the studs. Of course, a foam plane constructed according to the invention may be use for planing any of various low density materials without departing from the inventive concepts claimed, and it may be sized to cut a smaller or larger swath according to the requirements of the particular application.

Figure 3:
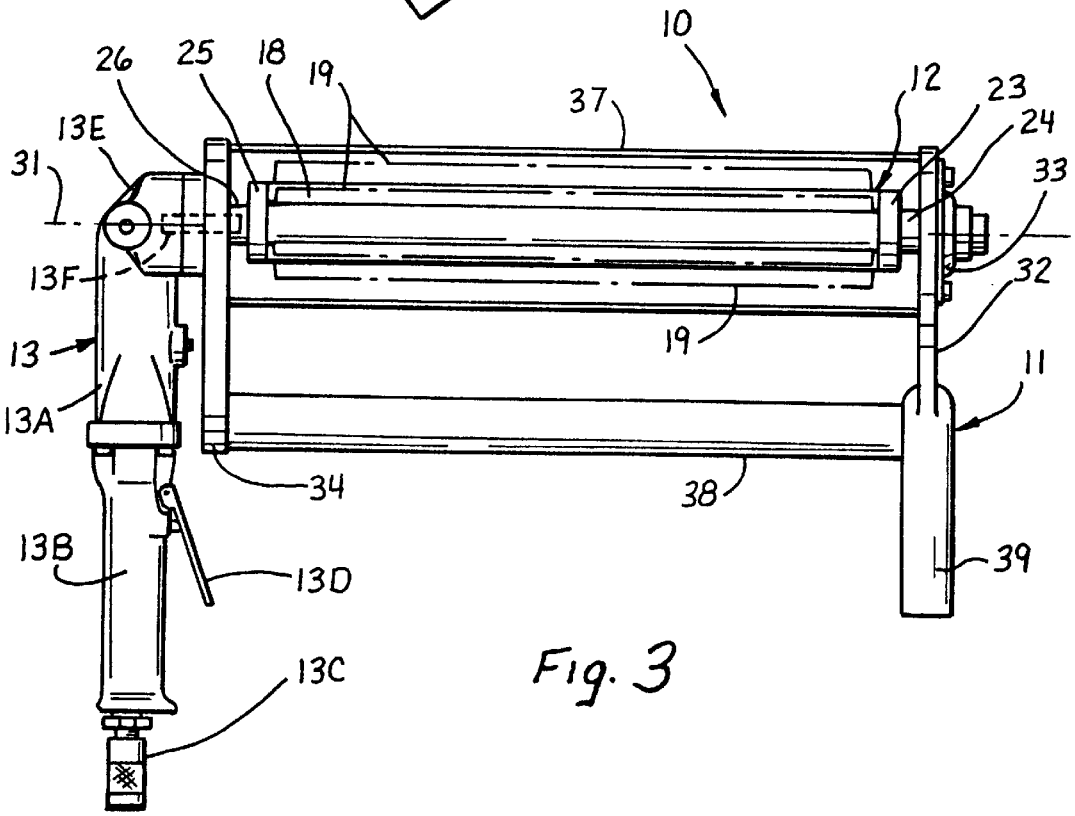
FIG. 3 is a bottom view of the foam plane.
Figures 4, 5, 6:
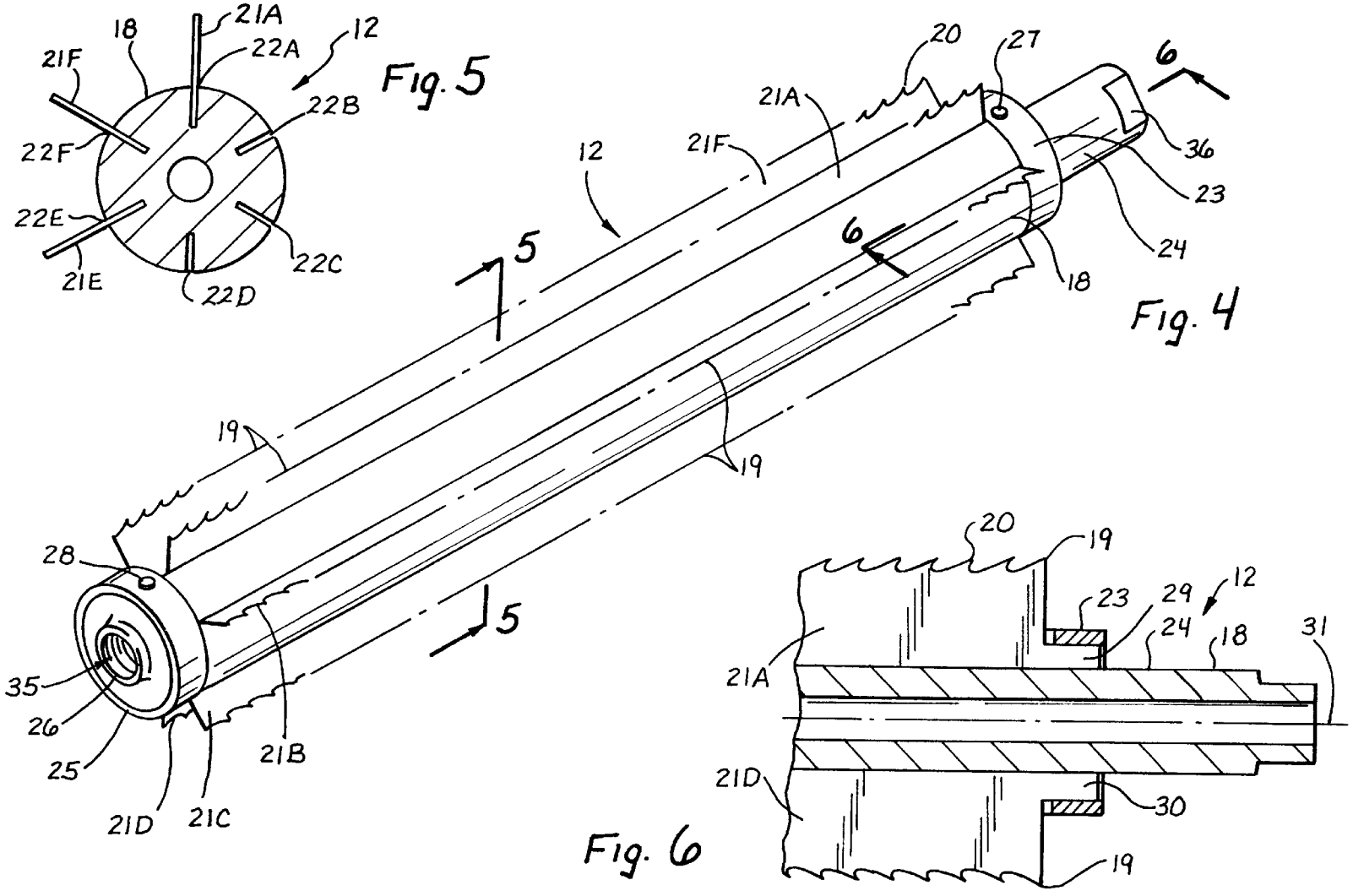
FIG. 4 is a further enlarged perspective view of the cutting element of the foam plane.
FIG. 5 is a transverse cross sectional view of the cutting element taken on line 5—5 of FIG. 4, with three of the six blades removed in order to emphasize the slots in the drum.
FIG. 6 is a longitudinal cross sectional view of a portion of the cutting element taken on line 6—6 of FIG. 4.

According to a major aspect of the invention, the cutting element 12 includes a drum 18 and a plurality of longitudinally extending rows of radially protruding teeth on the drum 18 (FIGS. 3, 4, and 6). The longitudinally extending rows are similar, three rows 19 being designated in FIG. 3, four rows 19 being designated in FIG. 4, and two rows 19 in FIG. 6. Only one tooth 20 is designated in FIGS. 4 and 6, but each row 19 includes a plurality of teeth 20 as illustrated.

The illustrated cutting element 12 has six longitudinally extending rows 19 of teeth 20. The rows 19 are circumferentially spaced apart on the drum 18 at equal intervals (i.e., every 60-degrees), and they are accomplished for the illustrated cutting element 12 by mounting identical six 15-inch long by 1.0-inch wide by 0.035-inch thick blades 21A–21F in six longitudinally extending slots 22A–22F in the drum 18. The blade 21E is not visible in FIG. 4, and only the three blades 21A, 21E, and 21F are illustrated in FIG. 5 within the slots 22A, 22E, and 22F for illustrative convenience in order to leave the slots 22B, 22C, and 22D open for clarity.

The drum 18 is a 1.75-inch outside diameter, hollow, aluminum element, and it defines the six 0.040-inch wide slots 22A–22F at even 60-degree circumferential intervals. The blades 21A–21F are cut from a section of commercially available band saw blade, although they may be otherwise fabricated from any of various known materials. They are retained on the drum 18 within the slots 22A–22F by a first retainer collar 23 on a first end portion 24 of the drum 18 (FIGS. 3, 4, and 6) and by a second retainer collar 25 on a second end portion 26 of the drum 8 (FIGS. 3 and 4).

The retainer collars 23 and 25 are 1.75-inch outside diameter metal rings having 1.5-inch inside diameters. FIG. 6 shows that the first end portion 24 of the drum 18 is reduced to a 1.5-inch diameter and in that way adapted to receive the collar 23 fits on it in the position illustrated. The second end portion 26 of the drum 18 is adapted to receive the collar 25 in the same way. The collars 23 and 25 may include set screws that hold them in place on the drum 18 while enabling the user to loosen the collars for blade replacement purposes. The set screw aspect is illustrated in FIG. 4 by a set screw 27 on the collar 23 and a set screw 28 on the collar 25. In addition, each end of the blades 21A–21F is formed to include 0.5-inch long by 0.25-inch wide section that fits under the retainer collars 23 and 25. In other words, the ends of the blades are notched to fit. That aspect is illustrated in FIG. 6 by a blade section 29 of the blade 21A and a blade section 30 of the blade 21D.

The cutting element 12 mounts rotatably on the frame 11 for rotation about an axis of rotation 31 that is shown in FIGS. 3 and 6. The first end portion 24 of the drum 18 is rotatably mounted on an aluminum first side member 32 of the frame 11 by a bearing 33. The second end portion 26 of the drum 18 is rotatably mounted on an aluminum second side member 34 of the frame 11 by securing the motor 13 to the second side member 34 (e.g., with screws) and coupling the second end portion 26 of the drum 18 to the rotatable drive shaft of the motor 13. The drum 18 includes a threaded bore 35 for that purpose (FIG. 4) that receives the threaded drive shaft 13F of the motor 13 that is depicted diagrammatically in FIG. 3 in broken lines.

The illustrated motor 13 is a commercially available air motor, available from known sources such as Prestige, Chicago Pneumatic, and Ingersol Rand. Having an overall length of about 14 inches and operating at 4500 RPM, it includes an air motor section 13A (FIG. 3) a handle 13B, an inlet connector 13C that connects to a source of compressed air (not shown), a spring-loaded dead-man safety switch 13D that the user 14 depresses to activate the motor 13, and a 90-degree angle drive 13E that attaches to the second side member 34 of the frame 11. Releasing the switch 13D deactivates the motor 13.

The 90-degree angle drive 13E includes a threaded drive shaft 13F (depicted diagrammatically in FIG. 3 by broken lines) that rotates when the motor 13 is activated. The threaded bore 35 in the drum 18 mates with the threaded drive shaft 13F to provide direct coupling between the cutting element 12 and the motor 13 without a chain drive. The first end portion 24 of the drum 18 includes a slotted portion 36 (FIGS. 2 and 4) that is adapted to receive a wrench so that the user 14 can rotate the drum 18 with the wrench in order to tighten the drum 18 onto the threaded shaft 13F of the motor 13.

In addition, a semi-circularly shaped first aluminum cross member 37 and a cylindrically shaped second aluminum cross member 38 of the frame 11 are attached to the first and second side members 32 and 34 to provide additional rigidity to the frame 11. The first side member 32 includes a first handle 39 that the user 14 grasps with his left hand while grasping the handle 13B on the air motor 13 with his right hand.

Operatively, the user 14 connects the inlet connector 13C to a source of compressed air. Next, he grasps the first handle 39 with one hand (e.g., his left hand) and the second handle 13B with his other hand. Holding the foam plane 10 in two hands that way, the user 14 positions it over the foam. Then he depresses the dead-man switch 13D and moves the foam plane 10 across the foam while the cutting element 12 rotates so that the teeth 20 on the blades 21A–21F plane the foam. To change blades, he loosens the retainer collars 23 and 25, removes the one or more blades to be replaced, inserts the new blade, and re-tightens the collars.

Thus, the invention provides a foam plane having a new and improved cutting element and chain-free coupling to the air motor. The cutting element includes a rotatably mounted drum with several longitudinally extending rows of radially protruding teeth for improved planing action and less damage when hitting a nail. The rows of teeth are accomplished by removably mounting several straight, flat blades in several longitudinally extending slots in the drum, preferably using commercially available blade stock held in place by removable retainer collars that facilitate quick and easy blade replacement. Although an exemplary embodiment has been shown and described, one of ordinary skill in the art may make many changes, modifications, and substitutions without necessarily departing from the spirit and scope of the invention.

What is claimed is:

1. An apparatus for planing foam, comprising:

a frame;

a cutting element mounted rotatably on the frame; and means in the form of a motor on the frame for rotating the cutting element as a user moves the cutting element across a body of foam for purposes of planing the foam;

wherein the cutting element includes a drum rotatable mounted on the frame and a plurality of longitudinally extending rows of radially protruding teeth on the drum;

wherein the drum extends along an axis of rotation of the drum between first and second end portions of the drum, and the drum defines at least one longitudinally extending slot in the drum that extends between the first and second end portions of the drum;

wherein the cutting element includes at least one elongated blade having opposite first and second marginal edge portions extending between opposite first and second end portions of the blade, the blade is disposed within the slot in the drum, and the first marginal edge portion of the blade includes a plurality of teeth such that with the blade mounted in the slot in the drum, the teeth protrude radially outward from the drum; and wherein the cutting element includes means in the form of at least a first collar on the first end portion of the drum for engaging the first end portion of the blade in order to removably retain the blade in the slot while facilitating blade replacement.

2. An apparatus for planing foam, comprising:

a frame;

a cutting element mounted rotatably on the frame; and means in the form of a motor on the frame for rotating the cutting element as a user moves the cutting element across a body of foam for purposes of planing the foam;

wherein the cutting element includes a drum extending along an axis of rotation of the drum between first and second end portions of the drum, the drum defining at least one longitudinally extending slot in the drum that extends between the first and second end portions of the drum;

wherein the cutting element includes at least one elongated blade having opposite first and second marginal edge portions extending between opposite first and second end portions of the blade, said blade being disposed within the slot in the drum and the first marginal edge portion of the blade including a plurality of teeth such that with the blade mounted in the slot in the drum, the teeth protrude radially outward from the drum; and wherein the cutting element includes means in the form of at least a first collar on the first end portion of the drum for engaging the first end portion of the blade in order to removably retain the blade in the slot while facilitating blade replacement.

3. An apparatus as recited in claim 2, wherein the drum has six longitudinally extending slots at circumferentially spaced apart intervals on the drum, which slots are adapted to receive six blades.

4. An apparatus as recited in claim 3, wherein:

the frame includes a handle adapted to function as a first handle for the apparatus; and the motor is mounted on the frame in a position such that the motor is adapted to function as a second handle for the apparatus.

5. An apparatus as recited in claim 2, wherein the drum includes means in the form of a second collar on the second end portion of the drum for engaging the second end portion of the blade.

6. An apparatus as recited in claim 2, wherein the blade takes the form of a section of band saw blade.

7. An apparatus as recited in claim 2, wherein the motor is a pneumatically powered motor.

8. An apparatus as recited in claim 2, wherein:

the motor includes a threaded shaft that rotates when the motor is activated; and the second end portion of the drum includes a threaded bore adapted to receive the threaded shaft of the motor in order to couple the drum to the motor.

* * * * *